US005494413A

United States Patent [19]

Campen et al.

[11] Patent Number: 5,494,413

[45] Date of Patent: Feb. 27, 1996

[54] HIGH SPEED FLUID PUMP POWERED BY AN INTEGRAL CANNED ELECTRICAL MOTOR

[75] Inventors: Clifford H. Campen, Plum Boro; Luciano Veronesi; James A. Drake, both of O'Hara Township; Leonard S. Jenkins, Plum Borough; Joseph M. Kujawski, Export, all of Pa.

[73] Assignee: Westinghouse Electric Corporation, Pittsburgh, Pa.

[21] Appl. No.: 164,299

[22] Filed: Dec. 9, 1993

[51] Int. Cl.[6] ..... F04B 35/04

[52] U.S. Cl. ..... 417/356; 417/368; 417/423.8; 417/423.12

[58] Field of Search ..... 417/356, 357, 417/366, 368, 423.8, 423.12

[56] References Cited

U.S. PATENT DOCUMENTS

| | | | |
|---|---|---|---|
| 2,949,540 | 8/1960 | Clayton | 417/356 |
| 3,143,972 | 8/1964 | Smith et al. | 417/356 |
| 4,050,849 | 9/1977 | Sheets . | |
| 4,341,173 | 7/1982 | Hagelberg et al. . | |
| 4,474,561 | 10/1984 | Haglund . | |
| 4,643,685 | 2/1987 | Nishida . | |
| 4,718,870 | 1/1988 | Watts . | |
| 4,917,637 | 4/1990 | Soga et al. . | |
| 5,101,128 | 3/1992 | Veronesi et al. . | |
| 5,185,545 | 2/1993 | Veronesi et al. | 440/38 |
| 5,289,068 | 2/1994 | Veronesi et al. | 440/38 |

FOREIGN PATENT DOCUMENTS

| | | | |
|---|---|---|---|
| 1134967 | 4/1957 | France | 417/356 |

*Primary Examiner*—Charles Freay

[57] ABSTRACT

A fluid pump powered by an integral canned motor includes a housing having a cylindrical passage extending therethrough. A sealed annular stator is mounted around the housing. An impeller assembly is rotatably mounted in the passage in the housing. The impeller assembly includes an axial flow impeller and a sealed rotor mounted around the periphery of the impeller. Bearings, including thrust bearings, are mounted between the periphery of the impeller assembly and the housing. A radial flow auxiliary impeller may be mounted on the impeller assembly to create a radial flow of water from the cylindrical passage in the housing to a peripheral fluid circulation channel between the impeller assembly and the housing. The auxiliary flow impeller pressurizes the peripheral fluid circulation channel.

14 Claims, 4 Drawing Sheets

HIGH SPEED FLUID PUMP POWERED BY AN INTEGRAL CANNED ELECTRICAL MOTOR

BACKGROUND OF THE INVENTION

1. Field of the Invention

This invention relates to fluid circulation pumps, and, more particularly, to high specific speed pumps having integral electric motors.

2. Description of the Prior Art

Many chemical processes utilize fluid pumps to circulate fluids, such as water and industrial chemicals, in reactors, distribution columns, kettles, water treatment plants and the like. Pumps in that type of service typically produce comparatively high flow rates at low heads and operate at relatively high specific speeds.

One conventional device for providing circulation of fluids in such installations is a shaft sealed circulator, or elbow pump, of the type shown in FIG. 1. An axial flow impeller I is positioned inside the pipe P through which the fluid is being circulated adjacent to an elbow in the pipe. Impeller I is connected to a cantilevered shaft S. Shaft S extends through pipe P and exits through the wall W of the elbow portion of the pipe P. Seals X are provided between shaft S and wall W of pipe P where the shaft exits the pipe. The shaft is rotatably connected to a motor M, often through a belt drive BD. A bearing B is provided to rotatably support shaft S. Motor M rotates shaft S, which rotates impeller I. The rotation of impeller I produces a flow in the pumped fluid.

There are several disadvantages with that type of pump installation. The seals require a considerable amount of maintenance and must be replaced often. Some chemicals have a detrimental affect on the seals and improper alignment of the shaft can cause them to deteriorate. If the seals fail, leakage may occur, which could result in toxic emissions and hazards to personnel. In some installations, the seals may have to be isolated from the pumped fluid. In addition, the mechanical components of the drive used with prior art systems require a considerable amount of maintenance. The drive shaft length is limited, thereby requiring the motor and drive to be located near the impeller. Because the shaft must exit the pipe, suitable locations for the pump are limited to those adjacent to pipe elbows.

There is a need for a circulation pump that does not require a drive shaft for rotation of the impeller and the associated seals. There also is a need for a pump that can be installed in any desired location in a length of pipe. These and other needs have been met by this invention.

Summary of the Invention

This invention provides a fluid pump for circulating fluid in a pipeline. The pump includes a housing having a generally cylindrical passage extending therethrough. The housing may be provided with flanges on each end thereof for connecting the pump in series into a section of pipe to define a generally continuous flow path therethrough. A hermetically sealed annular stator is mounted around the housing. The stator has energizing means for electrically connecting it to a source of electrical power. An impeller assembly is rotatably mounted in the passage in the housing. The impeller assembly includes an impeller and a hermetically sealed rotor mounted around the perimeter of the impeller. The rotor is positioned inside the stator and is operatively associated therewith to define an induction motor. When the stator is energized, the rotor and impeller will rotate, creating a pumping action that produces pressurized flow of fluid through the cylindrical passage of the housing. Bearing means, including a thrust bearing, are mounted between the perimeter of the impeller and the housing to rotatably support the impeller assembly. A peripheral fluid circulation channel is defined between the rotor and stator.

In one embodiment, the impeller assembly includes a radial flow auxiliary impeller in communication with the peripheral fluid circulation channel and the cylindrical passage throughout the housing. Rotation of the auxiliary impeller produces fluid flow from the cylindrical passage in the housing to the peripheral fluid circulation channel to pressurize the peripheral fluid circulation channel.

A hollow shaft may be centrally positioned in the passage in the housing and is secured to the housing by one or more diffuser vanes. The impeller assembly is rotatably supported by the shaft. Self-aligning journal bearings for rotatably supporting the impeller assembly are mounted between the shaft and the impeller assembly.

The impeller assembly has a downstream peripheral end that cooperates with the housing to form a gap therebetween. The gap is in communication with the cylindrical passage through the housing and is positioned downstream from the impeller. In one embodiment, the gap includes a labyrinth seal between the housing and the impeller assembly. The labyrinth seals permits limited flow of fluid through the gap from the cylindrical opening in the housing and into the peripheral fluid circulation channel.

The stator may be provided with cooling means to dissipate heat generated from operation thereof.

The cylindrical passage in the housing of the pump is preferably of substantially equal inner diameter to the inner diameter of the pipes to which it is connected. The exterior of the housing is also preferably generally cylindrical in shape and is substantially equal in diameter to the diameter of the flanges thereof.

This invention will be more clearly understood from the following detailed description of the preferred embodiment on reference to the drawings appended hereto.

DETAILED DESCRIPTION OF PREFERRED EMBODIMENTS

Figure 1:
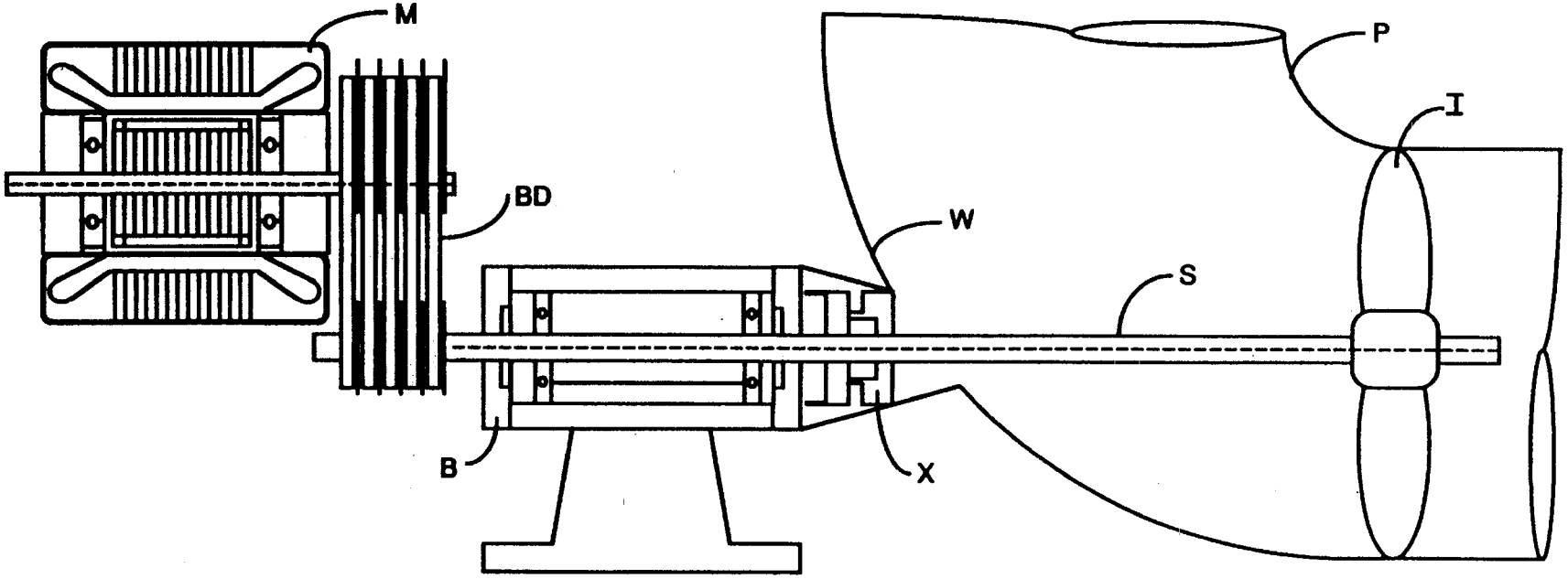
FIG. 1 PRIOR ART
FIG. 1 shows a schematic view of a prior art pump installation.
Figure 2:
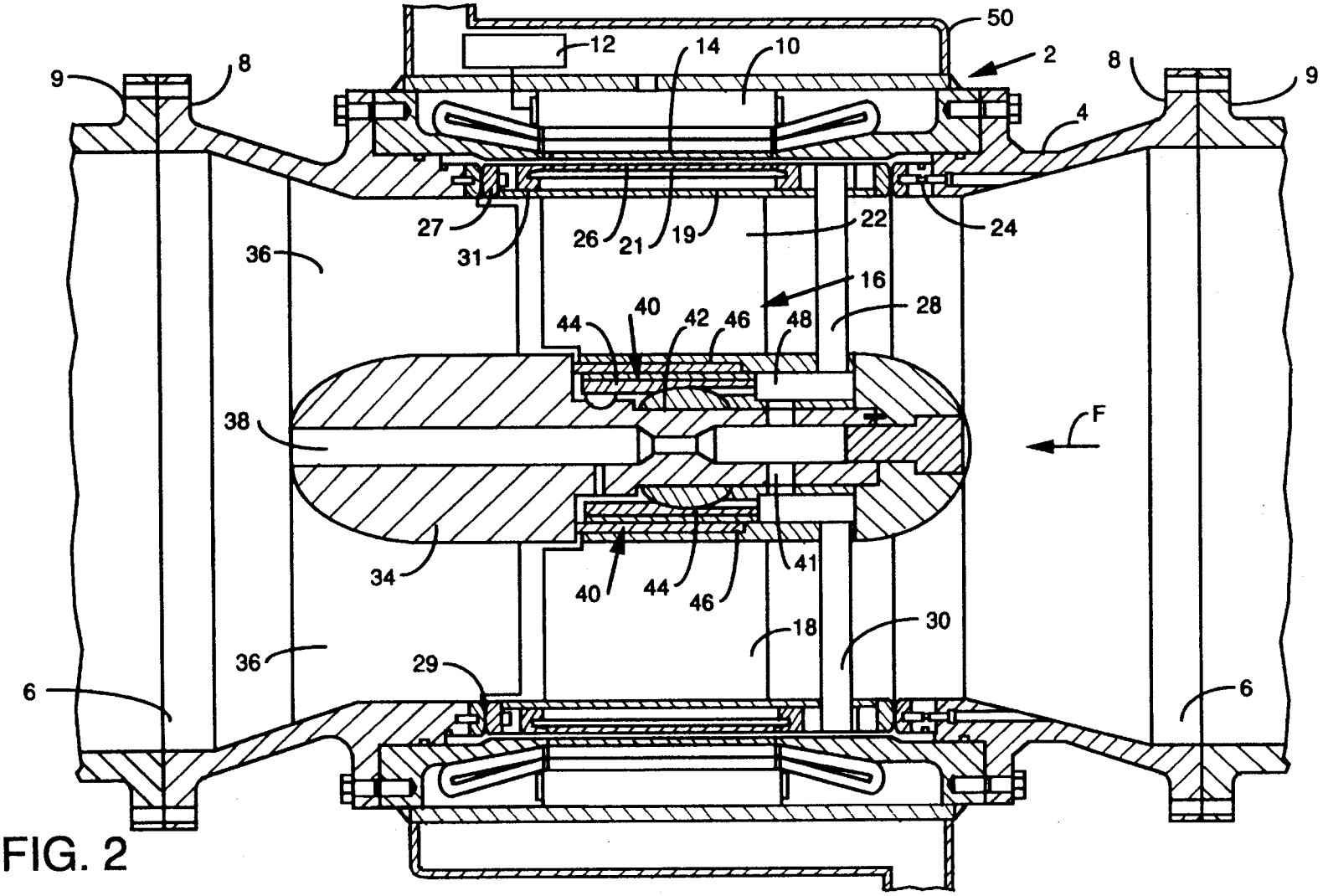
FIG. 2 shows a longitudinal sectional view of one embodiment of the fluid pump of this invention.

Referring to FIG. 2, there is shown a preferred embodiment of the fluid pump 2 of this invention. The pump includes a generally cylindrical housing 4 having a generally cylindrical passage 6 extending therethrough. Housing 4 also includes flanges 8 at each end thereof for connecting the housing in series with pipe sections 9 to define a continuous flow path between the pipe sections 9.

In a preferred embodiment, the inner diameter of housing 4 is substantially equal to or less than the inner diameter of the pipe sections to which it is to be connected. Flanges 8 permit pump 2 to be easily installed and removed from the pipeline as a modular unit. Alternatively, other connection means may be provided on housing 4 for connecting it to pipe sections 9.

Pump 2 further includes a hermetically sealed annular stator 10 mounted around housing 4. Stator 10 has energizing means 12 thereon for connecting stator 10 to a source of electrical power. Stator 10 is hermetically sealed by stator can 14.

Impeller assembly 16 is rotatably mounted inside passage 6 of housing 4. Impeller assembly 16 comprises an axial flow impeller 18 and an annular rotor 20 mounted around the perimeter of impeller 18 on cylindrical shroud 19. Rotor 20 is hermetically sealed by rotor can 21. Impeller 18 has a plurality of blades 22 mounted on and extending radially outwardly from cylindrical hub 23. In a preferred embodiment, 3 to 6 blades 22 are provided. It will be appreciated, however, that the optimum number of blades will depend on the desired performance of the pump and may be determined in a manner known to those skilled in the art. Blades 22 are pitched so as to create an axial flow in the pumped fluid in the direction F through the passage 6 in the housing 4 when the impeller 18 is rotated.

Impeller 18 is preferably a high specific speed impeller. Specific speed (Ns) is a non-dimensional design index used to classify pump impellers as to type and proportion. It is defined as the speed in revolutions per minute at which a geometrically similar impeller would operate if it were of such a size to deliver one gallon per minute against one foot head. Ns is calculated using the formula:

$$Ns = \frac{N\sqrt{Q}}{H^{3/4}}$$

where

N=pump speed in revolutions per minute

Q=capacity in gallons per minute at the best efficiency point

H=total head per stage at the best efficiency point

In a preferred embodiment, impeller 18 will be of a configuration to yield a specific speed of about 8,000 to 20,000 at a speed of 600 rpm or less.

Bearings rotatably support impeller assembly 16. The bearings include one or more thrust bearings 24 mounted between the perimeter of the impeller assembly 16 and housing 4 in a position upstream from impeller 18. Thrust bearing 24 is preferably a fixed height, fluid-cooled bearing. High specific speed impellers typically generate high thrust loads in the direction of the pump suction when shut off (as high as 300% or more of design thrust). By locating the thrust bearing 24 at the perimeter of impeller 18, the load bearing area of thrust bearing 24 is increased. In a preferred embodiment, thrust bearing 24 may be a fixed height pivoted pad type bearing, a fixed pad slider type bearing or a step pad hydrodynamic type bearing.

A thrust bumper 27 may be mounted between the perimeter of impeller assembly 16 and housing 4 at a position downstream from impeller 18. Thrust bumper 27 will reduce the likelihood of damage if the pump is started and run in reverse or if the pump must be started against reverse thrust.

Thrust bearing 24 is preferably mounted in a peripheral fluid circulation channel 26 defined between housing 4 and rotor 20. Peripheral fluid circulation channel 26 is preferably defined between rotor can 21 and stator can 14 and is in communication with passage 6 at both the upstream side of impeller 18 and the downstream side thereof.

A generally hollow shaft 34 is centrally positioned in cylindrical passage 6 in housing 4 and is secured to housing 4 by a plurality of diffuser vanes 36. Shaft 34 rotatably supports impeller assembly 16. Shaft 34 has a longitudinally extending shaft passageway 38 therein. Passageway 38 is in communication with cylindrical passage 6 in housing 4 at a position downstream from impeller 18.

One problem associated with large canned rotors for axial flow pumps is that they operate at relatively high surface speeds; the high surface speed may cause cavitation in the fluid flowing in the peripheral fluid circulation channel 26 between rotor can 21 and stator can 14. Pressurization of peripheral fluid circulation channel suppresses cavitation therein. Cavitation may cause damage of rotor can 21 and stator can 14. Venting the peripheral fluid circulation channel 26 to cylindrical passage 6 on the downstream side of impeller 18 provides some pressurization of peripheral fluid circulation channel 26. However, since high specific speed pumps operate at relatively low head, additional cavitation suppression is needed.

Figure 3:
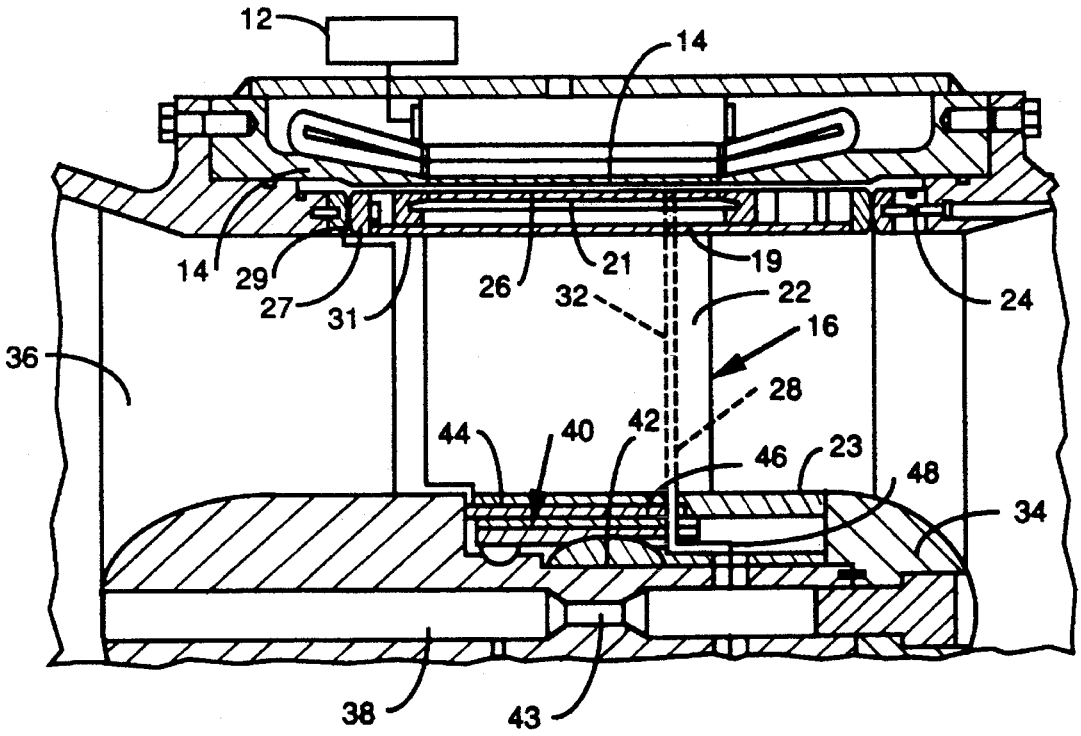
FIG. 3 shows a longitudinal sectional view of a portion of an embodiment of the auxiliary impeller of this invention.

In a preferred embodiment, impeller assembly 16 includes a radial flow auxiliary impeller 28 in communication with peripheral fluid circulation channel 26 and cylindrical passage 6 through housing 4 to pressurize peripheral fluid circulation channel 26. In a preferred embodiment, auxiliary impeller 28 is in communication with cylindrical passage 6 through passage 38 in shaft 34. Rotation of auxiliary impeller 28 with impeller assembly 16 produces a radial flow of fluid from cylindrical passage 6 to peripheral fluid circulation channel 26 to pressurize peripheral fluid circulation channel 26. The pressurization of peripheral fluid circulation channel 26 suppresses cavitation of fluid flowing therethrough. A portion of the fluid pumped by auxiliary impeller 28 will flow between rotor can 21 and stator can 14, to cool the motor, and exit peripheral fluid flow channel 26 into cylindrical passage 6 through a gap 29 between housing 4 and a downstream end 31 of impeller assembly 16 downstream from impeller 18. The pressure created by auxiliary impeller 28 restricts flow from passage 6 to peripheral fluid circulation channel 26 through gap 29. Another portion of the fluid pumped by auxiliary impeller 28 will flow across thrust bearing 24 and exit peripheral fluid flow channel therethrough into passage 6 upstream from impeller 18, thereby maintaining fluid flow across thrust bearing 24. In a preferred embodiment, auxiliary impeller 28 may be comprised of a plurality of tubes 30 spaced circumferentially around impeller assembly 28. Tubes 30 are in communication with peripheral fluid circulation channel 26 and cylindrical passage 6 through shaft passage 38 in shaft 34. Alternatively, as shown in FIG. 3, auxiliary impeller 28 may be comprised of radially extending conduits 32 inside blades 22 of impeller 18. Tubes 30 and conduits 32 may be sized to provide the desired pressurization of peripheral fluid circulation channel 26 and the desired flow across thrust bearing 24.

Referring again to FIG. 2, self-aligning journal bearing 40 are mounted between shaft 34 and impeller assembly 16 to rotatably support impeller assembly 16. Journal bearings 40 may include at least one fluid-cooled bearing having a spherical seat 42 with a pivoted pad 44 fixedly mounted on shaft 34 and a solid journal ring 46 mounted on impeller assembly 16 for rotation therewith. Alternatively, journal ring 46 may be cylindrically segmented. In a preferred embodiment, journal bearings 40 are mounted in hub fluid circulation channel 48 defined between shaft 34 and hub 23 of impeller assembly 16. Hub fluid circulation channel 48 is in communication with passage 38 in shaft 34 and with cylindrical passage 6 through channel 39, whereby fluid will flow from passage 38, through hub fluid circulation channel 48, and hence through bearing 40, and into auxiliary impeller 28 to cool and lubricate journal bearing 40. Passage 38 is also in communication with auxiliary impeller 28 through annulus 41 whereby fluid will flow to auxiliary impeller 28. Restriction 43 in passage 30 functions as a flow diverter to divert fluid flow into both channel 39 and annulus 41, which are connected in parallel to auxiliary impeller 28.

Cooling means may be provided for cooling stator 10. In installations where the temperature of the fluid being pumped is less than 250° F., the motor is cooled by fluid flowing in peripheral fluid circulation channel 26. In installations where the fluid is above 250° F., a cooling jacket 50 is mounted around housing 4. Cooling water is circulated through the cooling jacket 50 to cool the motor. In installations where the fluid temperature is above 350° F., a thermally resistive layer, such as wire mesh or carbon fibers, may be provided between the rotor can 21 and the stator can 14.

Figure 4:
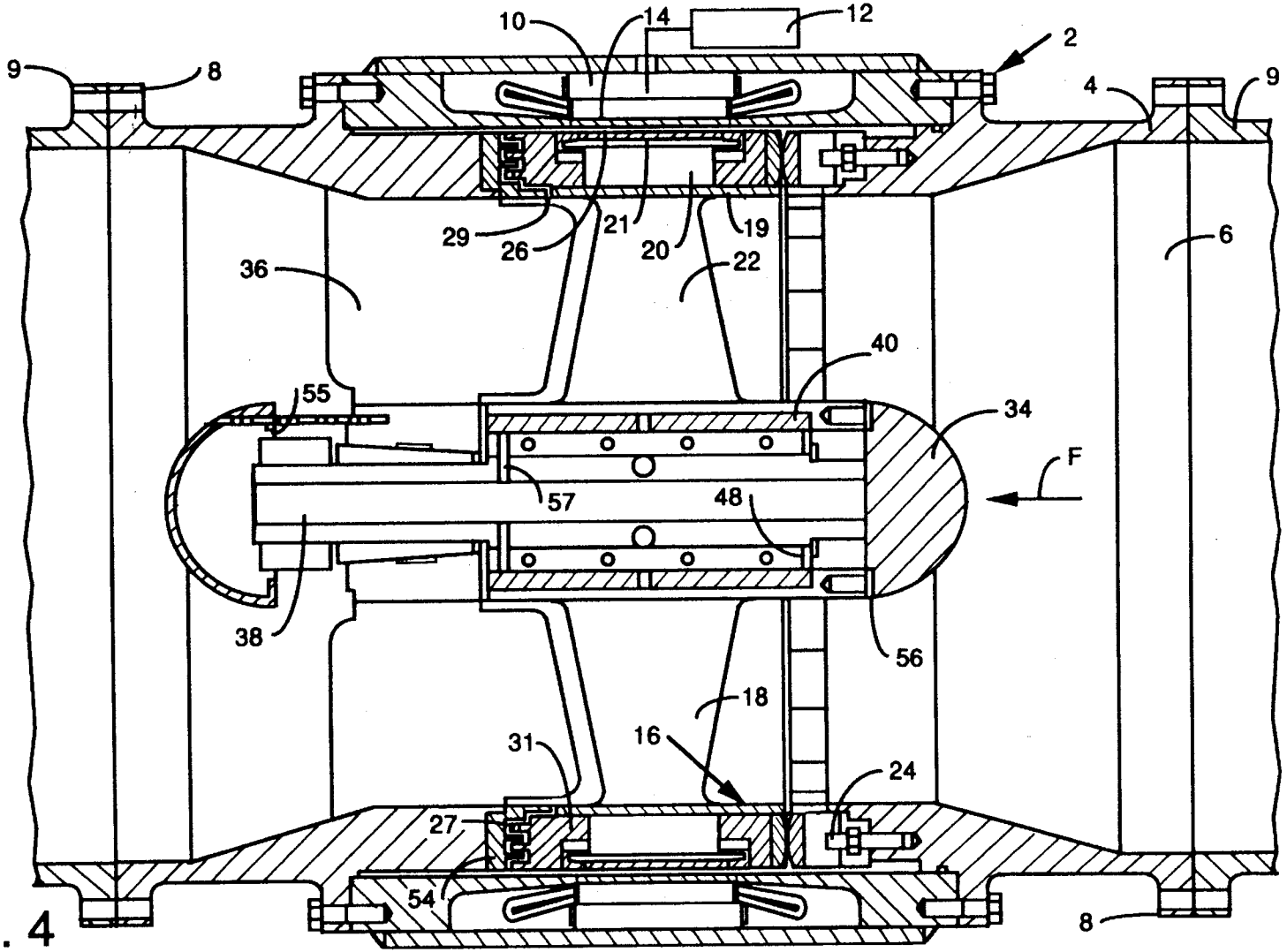
FIG. 4 shows a longitudinal sectional view of another embodiment of the fluid pump of this invention.

Referring to FIG. 4, them is shown another embodiment of this invention. The reference numbers used to describe the embodiment of FIG. 2 are used to identify like components of this embodiment, and reference is made to that portion of the discussion to describe the general structure of this embodiment.

In this embodiment, thrust bearings 24 are fixed height, pivoted pad bearings. No auxiliary impeller is provided in this embodiment to pressurize the peripheral fluid circulation channel in which thrust bearings 24 are mounted. However, fluid flows into gap 29, through peripheral fluid circulation channel 26 between rotor can 21 and stator can 14, across thrust bearing 24 and back into cylindrical passage 6. The flow therethrough is effected by the head created by rotation of impeller 18. Pressure is higher on the downstream side of the impeller than on the upstream side thereof. This fluid flow provides cooling for rotor 20 and stator 10 and cools and lubricates thrust bearing 24. In this embodiment, gap 29 includes a labyrinth seal 54 to restrict the flow of fluid through gap 52.

Cooling and lubrication of the journal bearings 40 is provided by fluid flowing thereacross. Fluid enters passage 38 in shaft 34 through inlet gap 55. Inlet gap 55 is downstream from impeller 18 where pressure is higher than on the upstream side. The fluid flows through one or more radial passages 57 into bearings 40. A fluid flow across bearings 40, the fluid exits into cylindrical passage 6 through hub gap 56 between shaft 34 and hub 23 of impeller assembly 16. Hub gap 56 is positioned upstream of impeller 18.

It will be appreciated that this invention provides a fluid pump for installation into a pipeline that does not require a drive shaft and the seals associated with the drive shaft. It will also be appreciated that the fluid pump of this invention may be installed in any desired location of a pipeline and does not extend radially appreciably beyond the external diameter of the pipes to which it is connected.

Whereas particular embodiments of this invention have been described for purposes of illustration, it will be apparent to those of ordinary skill in the art that numerous variations in details may be made without departing from the invention as described in the appended claims.

We claim:

1. A fluid pump comprising:

a housing having a generally cylindrical passage extending therethrough;

a sealed annular stator mounted around said housing, said stator having energizing means for electrically connecting said stator to a source of electrical power;

an impeller assembly rotatably mounted in said generally cylindrical passage in said housing, said impeller assembly comprising an impeller and a sealed rotor mounted around the perimeter of said impeller and positioned inside said stator to form an electric motor, the operation of which rotates said impeller to produce a pressurized flow of fluid through said generally cylindrical passage in said housing;

bearing means for rotatably supporting said impeller assembly, said bearing means including a thrust bearing mounted between said perimeter of said impeller and said housing;

a peripheral fluid circulation channel defined between said housing and said rotor, and in communication with said generally cylindrical passage through said housing through a gap formed between said housing and a downstream peripheral end of said impeller assembly;

said thrust bearing positioned in said peripheral fluid circulation channel;

said impeller assembly including a radial flow auxiliary impeller in communication with said peripheral fluid circulation channel and said generally cylindrical passage through said housing for producing fluid flow from said generally cylindrical passage to said peripheral fluid circulation channel to pressurize said peripheral fluid circulation channel;

a generally hollow shaft centrally positioned in said generally cylindrical passage in said housing and secured to said housing by at least one diffuser vane;

said impeller assembly rotatably supported by said shaft; and said shaft having a longitudinally extending shaft passageway therein in communication with said generally cylindrical passage in said housing at a position downstream from said impeller to supply fluid flow from said generally cylindrical passage to said auxiliary impeller.

2. The pump of claim 1, wherein said thrust bearing being at least one fixed height, fluid-cooled bearing.

3. The pump of claim 1, wherein self-aligning journal bearing means for rotatably supporting said impeller assembly are mounted between said shaft and said impeller assembly.

4. The pump of claim 3, wherein said journal bearing means include at least one self-aligning, water cooled bearing having a spherical seat with a pivoted pad mounted on said shaft and a solid journal ring mounted on said impeller assembly for rotation with said impeller assembly.

5. The pump of claim 3, wherein said journal bearing means include at least one self-aligning, water cooled bearing having a spherical seat and a pivoted pad mounted on said shaft and a cylindrically segmented journal ring mounted on said impeller assembly for rotation with said impeller assembly.

6. The pump of claim 3, wherein a hub fluid circulation channel is defined between said shaft and said impeller assembly, said hub fluid circulation channel being in communication with said shaft passageway in said shaft; and said journal bearing means are positioned in said hub fluid circulation channel.

7. The pump of claim 6, wherein said radial flow auxiliary impeller is in communication with said shaft passageway and said peripheral fluid circulation channel for producing pressurized fluid flow from said shaft passage to said peripheral fluid circulation channel to pressurize said peripheral fluid circulation channel.

8. The pump of claim 7, wherein said auxiliary impeller includes at least one radially extending tube on said impeller assembly.

9. The pump of claim 7, wherein said auxiliary impeller includes at least one radially extending conduit in at least one of the blades of said impeller.

10. The pump of claim 1, wherein said gap includes a labyrinth seal between said housing and said impeller assembly.

11. The pump of claim 1, wherein said housing includes cooling means for cooling said stator.

12. A modular fluid pump for mounting in a length of pipe, comprising:

a housing having a generally cylindrical opening therethrough and connection means at each end for connecting said housing in series with pipe sections to define a flow path between said pipe sections;

a sealed annular stator mounted around said housing, said stator having energizing means for electrically Connecting said stator to a source of electrical power;

an impeller assembly rotatably mounted in said generally cylindrical passage in said housing, said impeller assembly comprising an impeller and a sealed rotor mounted around the perimeter of said impeller and positioned inside said stator to form an electric motor, the operation of which rotates said impeller to produce a pressurized flow of fluid through said housing;

bearing means for rotatably supporting said impeller assembly in said passage in said housing, said bearing means including a thrust bearing;

a peripheral fluid circulation channel defined between said housing and said rotor, and in communication with said generally cylindrical passage through said housing through a gap formed between said housing and a downstream peripheral end of said impeller assembly;

said thrust bearing being positioned in said peripheral fluid circulation channel;

said impeller assembly including a radial flow auxiliary impeller in communication with said peripheral fluid circulation channel and said generally cylindrical passage in said housing for producing fluid flow from said generally cylindrical passage to said peripheral fluid circulation channel to pressurize said peripheral fluid circulation channel;

a generally hollow shaft centrally positioned in said generally cylindrical passage in said housing and secured to said housing by at least one diffuser vane;

said impeller assembly rotatably supported by said shaft; and self-aligning journal bearing means for rotatably supporting said impeller assembly and mounted between said shaft and said impeller assembly.

13. The pump of claim 12, wherein said gap includes a labyrinth seal between said housing and said impeller assembly.

14. The pump of claim 12, wherein said housing includes cooling means for cooling said stator.

* * * * *